US007552507B2

(12) United States Patent
Burnham

(10) Patent No.: US 7,552,507 B2
(45) Date of Patent: Jun. 30, 2009

(54) CLEANING HEAD FOR A VACUUM CLEANER

(75) Inventor: Gavin Burnham, Droitwich (GB)

(73) Assignee: VAX Limited, Droitwich (GB)

( * ) Notice: Subject to any disclaimer, the term of this patent is extended or adjusted under 35 U.S.C. 154(b) by 0 days.

(21) Appl. No.: 11/851,838

(22) Filed: Sep. 7, 2007

(65) Prior Publication Data

US 2008/0060162 A1 Mar. 13, 2008

(30) Foreign Application Priority Data

Sep. 9, 2006 (GB) ..... 0617767.9

(51) Int. Cl.
*A47L 9/02* (2006.01)

(52) U.S. Cl. ..... 15/416; 15/419

(58) Field of Classification Search ..... 15/416, 15/419; *A47L 9/02*

See application file for complete search history.

(56) References Cited

U.S. PATENT DOCUMENTS 6,039,817 A * 3/2000 Payne ..... 134/21
7,377,009 B2 * 5/2008 Lee et al. ..... 15/331

FOREIGN PATENT DOCUMENTS

EP 1120076 8/2001

OTHER PUBLICATIONS

GB0617767.9 Search Report, 1 page, Dec. 21, 2006.

* cited by examiner

*Primary Examiner*—David A Redding
(74) *Attorney, Agent, or Firm*—Michael Best & Friedrich LLP

(57) ABSTRACT

A cleaning head for a vacuum cleaner comprises a housing for facing a surface being cleaned, a first suction opening, a brush bar operable on the surface being cleaned through the first suction opening, a second suction opening and means for switching suction air flow between the first and second suction openings as required. The second suction opening may be narrower than the first opening, to provide a higher speed of suction airflow and hence improved dust collection when the brush bar is not being operated.

18 Claims, 5 Drawing Sheets

CLEANING HEAD FOR A VACUUM CLEANER

CROSS-REFERENCE TO RELATED APPLICATIONS

This application claims priority from United Kingdom application number 0617767.9, filed on Sep. 9, 2006, the entirety of which is fully incorporated by reference herein.

BACKGROUND

This disclosure relates to a cleaning head for a vacuum cleaner (suction cleaner).

A cleaning head in accordance with the invention may be for use with a vacuum cleaner of the "cylinder" (or "canister") type, in which the head is connected by a hose and (usually) a wand assembly to a separate cleaner body. The cleaner body contains a motor and impeller for creating a suction airflow, and a separating apparatus which separates dirt and dust from the dirty airflow sucked from whatever is being cleaned, and retains the separated dirt and dust for disposal when required. Alternatively, the head may form part of a cleaner of the "upright" type, such a cleaner including a cleaning head part movable over a floor surface and a body to which the head is pivotally connected, the body having a handle by which a user is able to move the entire cleaner as required over a floor surface. The separating apparatus usually is carried by the body. An upright cleaner may have a hose and wand enabling cleaning of things other than a floor surface, and a cleaning head in accordance with the invention may be used with a hose and wand of an upright cleaner just as it is usable with a hose or wand of a cylinder cleaner.

Yet further, "central" or "built in" vacuum cleaning systems are known, wherein a building is provided with a system of ducting leading from a central suction airflow-creating and dust separating-collecting unit to a number of connection points in different places in the building, at which a hose and wand assembly is or can be connected. A cleaning head in accordance with the invention may be used with such a hose and wand assembly in the same manner as with the hose and wand assembly of a cylinder cleaner.

The cleaning head part of an upright cleaner has a housing affording a suction opening facing a floor surface to be cleaned, and a duct for conveying suction airflow from the suction opening to the dust separating/collecting, and airflow creating, components of the cleaner. It is usual to provide a rotatable agitating element, such as a brush and/or beater bar, in the housing, with a circumferential part of the brush bar protruding through the suction opening so as to be able to assist cleaning of the floor surface. Such an agitating element is particularly useful where it is a carpeted surface which is being cleaned.

A rotatable brush bar can also be provided in a cleaning head for a cylinder type of vacuum cleaner. Arrangements are known for the supply of electrical power along a hose and wand to power an electric motor for driving the brush bar, but a more common solution adopted for driving the brush bar in the cleaning head of a cylinder type cleaner is to incorporate a turbine in the cleaning head, operated by the suction airflow. A so-called "turbo-brush" can greatly improve the cleaning capability of a cleaning head for use on carpeted floor surfaces.

One disadvantage of a cleaning head with a brush bar is that the suction opening necessarily has a relatively large cross-sectional area, so the speed of the suction airflow through it is reduced as compared with what it would be if the opening were smaller. This can lead to some reduction in the ability of the cleaning head to suck up dust and dirt from hard floor surfaces, where the action of a brush bar is less helpful. It is an object of the present invention to address this problem of a cleaning head having an agitating element such as a brush bar.

BRIEF SUMMARY

According to the present invention, we provide a cleaning head for a vacuum cleaner, comprising a housing with a first suction opening for facing a surface being cleaned; an agitating element operable on the surface being cleaned through the first suction opening; a second suction opening facing the surface being cleaned; and means operable to switch the suction airflow between the first and second suction openings as required.

An advantage of the invention is that because the second suction opening does not have to provide for the presence, within the housing of the cleaning head, of an agitating element, of which a part extends through the suction opening to operate on a surface being cleaned, the second suction opening can be much narrower than the first suction opening, enabling a high speed of suction airflow through it and hence effective dust and dirt ingestion.

The agitating element may comprise a rotatable brush and/or beater bar, drivable so as to operate on the surface being cleaned.

The second suction opening preferably extends transversely of the housing of the cleaning head, facing the surface being cleaned at a position in front of the first suction opening having regard to the normal direction in which the cleaning head is used.

The agitating element may be drivable by a turbine powered by suction airflow, the turbine being disposed in a duct leading from the first suction opening to an airflow outlet part of the housing. Alternatively, the agitating element may be drivable by an electric motor. In the case of a cleaning head for a cylinder type cleaner, such an electric motor may be dedicated to this purpose (i.e. drive only the agitation element), and electrical power for driving it may be delivered along a hose and wand to which the cleaning head is connected. In the case of an upright cleaner, the agitating element may be drivable by a dedicated electric motor, which is drivingly connected to the agitating element, or by a suitable driving connection to a main motor of the cleaner which also creates the suction airflow.

Preferably, the means which switches the suction airflow between the first and second suction openings is also operable to stop the agitating element from being driven when the suction airflow flows through the second suction opening. This is advantageous because, under some circumstances, it is possible for a rotating brushbar to cause some damage to a hard floor surface, such as a polished surface, through constant abrasion.

The ability to stop the brushbar being driven overcomes this problem, whilst pick-up of dirt is improved by use of the second suction opening. It would however, be possible for a brush bar still to be driven even when the airflow is switched to the second suction opening.

In the case where the agitating element is driven by a suction airflow-powered turbine, the second suction opening may lead into a second duct which joins the first duct downstream of the turbine. The switching means may comprise a blocking member which blocks the first or second duct, as required.

Where the agitating element is driven by a dedicated electric motor, the means which switches the suction airflow between the first and second suction openings may operate an electrical switch to switch off the agitating element motor when the suction airflow is switched to the second suction opening.

In the case of an upright cleaner where the agitating element is driven by an electric motor which also creates the suction airflow, the operation of the means for switching the suction airflow between the first and second suction openings may cause disengagement of a clutch device in a drive train by which the agitating element is driven, when the suction airflow is directed to the second suction opening.

Preferably the second suction opening presents a cross-sectional area which is substantially less than that of the first suction opening, so that the speed of flow of the suction airflow through it is greater than through the first suction opening.

BRIEF DESCRIPTION OF THE DRAWINGS

The invention will now be described by way of example with reference to the accompanying drawings, of which.

DETAILED DESCRIPTION

Figure 1:
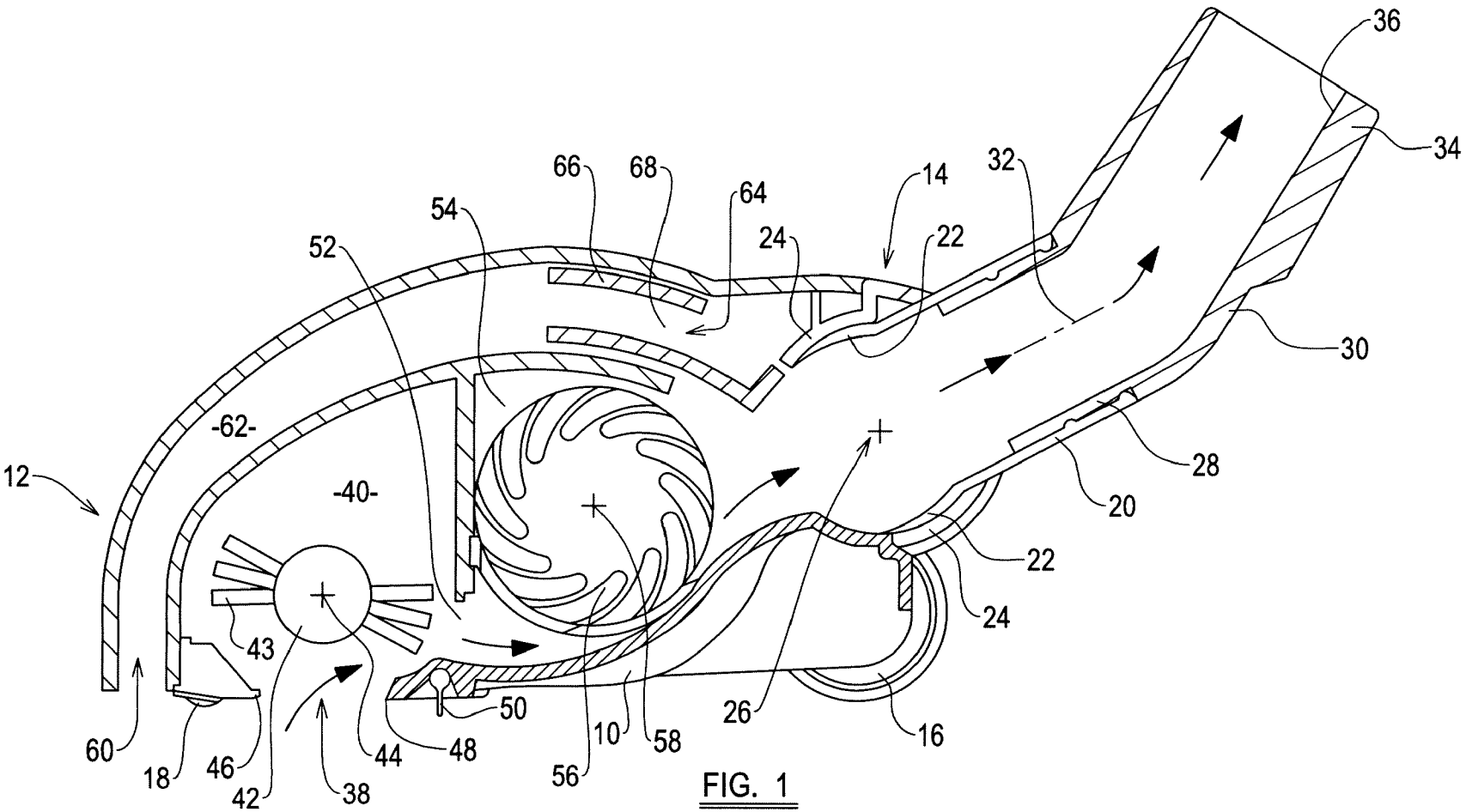
FIG. 1 is a sectional view of an embodiment of a cleaning head in a first mode of operation.
Figure 2:
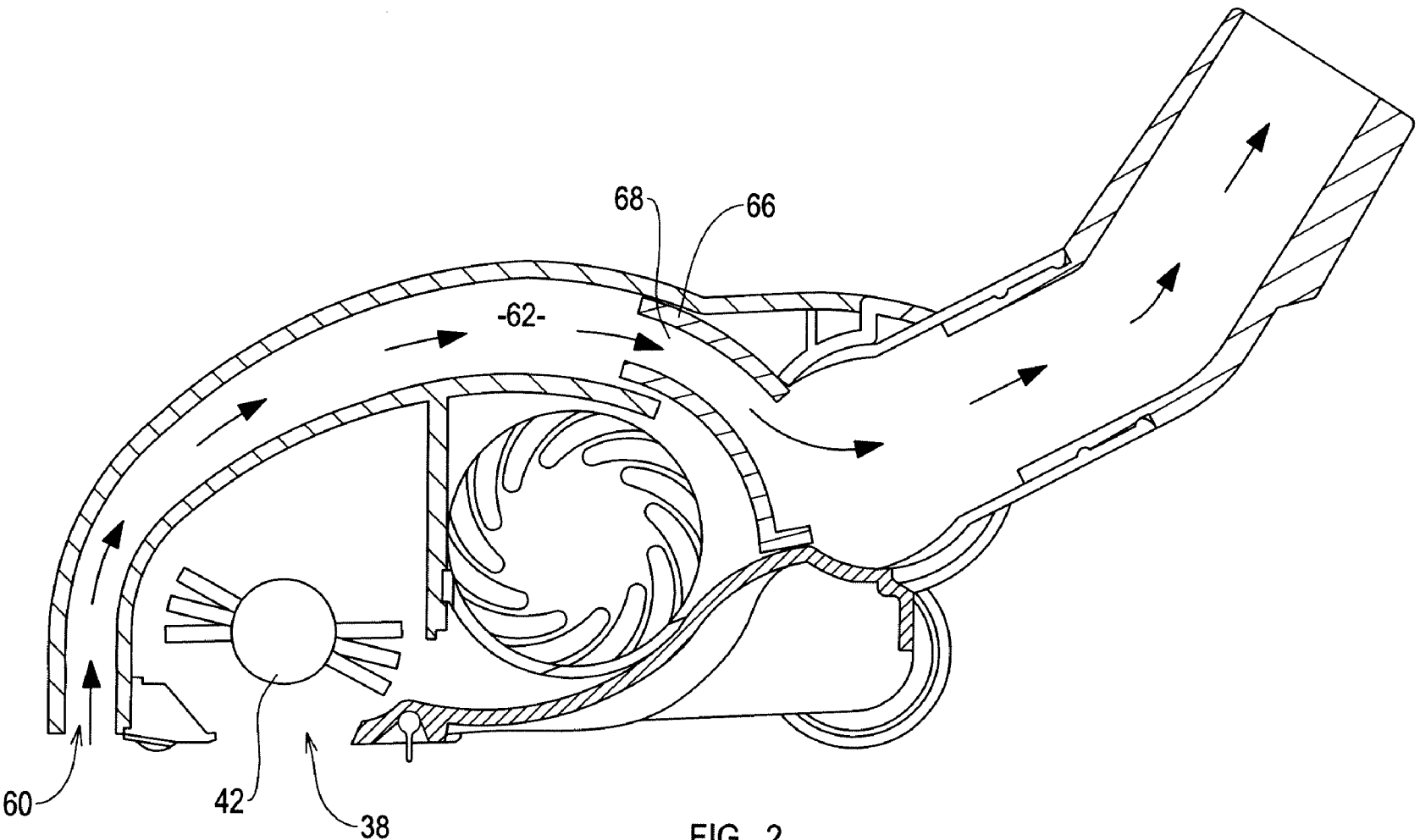
FIG. 2 is the view of FIG. 1 in a second mode of operation.

Referring firstly to FIGS. 1 and 2 of the drawings, they illustrate a cleaning head intended for use with a vacuum cleaner of the cylinder type. Thus the cleaning head is adapted for connection to the end of a wand which will be connected to the cleaner by a flexible suction hose. The cleaning head comprises a housing 10 having a front end 12 and rear end 14. The cleaning head is able to be supported on a surface being cleaned such as a floor surface, and moved forwardly and rearwardly over such surface, on laterally spaced rear wheels 16 and front rollers 18.

At the rear end 14 of the housing 10, for connection to a wand, a tubular outlet collar 20 is provided. At its forward end, the collar 20 has part-cylindrical wall portions 22 which are received in complementary part-cylindrical internal wall portions 24 of the housing 10, so that the collar 20 is pivotable relative to the housing, to a limited extent, about a transverse axis 26. A rear part of the collar 20, externally of the housing 10, receives a neck portion 28 of a connection elbow 30, holding the latter captive and providing for pivotal movement of the elbow 30 about an axis 32 extending longitudinally through the collar 20. A rear portion 34 of the elbow 30 has its interior passage tapered where indicated at 36, to receive as a push fit an end portion of the wand. It will be appreciated that the above-described configuration of the neck 20 and elbow 30 provides a duct for outflow of the suction airflow to the wand, and the pivoting capability of the cleaning head about two axes relative to the wand enables a user easily to manoeuvre the cleaning head over a surface, such as a floor surface, being cleaned.

The housing 10 of the cleaning head affords a first suction opening 38, facing a surface on which the head is supported. The housing affords a chamber 40 above the opening 38, and in this chamber a transversely oriented agitating element in the form of a brush bar 42, having bristles as indicated as 43, is supported for rotation about an axis 44 extending transversely of the cleaning head. The suction opening 38 extends across the cleaning head over substantially its entire width, and is bounded at its front end by an edge 46 and its rear edge by an edge 48. The dimensions are such that the bristles 43 of the brush bar 42 are able to extend downwardly through the opening 38 to just engage a surface on which the cleaning head rests. Rearwardly of the rear edge 48 of the opening 38, a flexible wiper blade 50 is provided, for lightly engaging the floor surface.

A duct 52 for suction airflow extends rearwardly from the brush chamber 40 and leads into a turbine chamber 54 within which is disposed a turbine rotor 56 drivable by the suction airflow, and rotatable about a transverse axis 58. The turbine rotor 56 is connected to the brush bar 42 for driving the latter, by a drive belt for example. Rearwardly of the turbine rotor 56, the chamber 54 opens into the vicinity of the front end of the collar 20.

At the front 12 of the housing 10, the housing affords a second suction opening 60 facing downwardly and spaced slightly above a surface on which the cleaning head is supported. This suction opening is in the form of a narrow slot. A second duct extends upwardly and rearwardly as indicated at 62 from the opening 60, to a rearmost part 64 above the turbine chamber 54. A switching member 66 is slidably supported in the rearmost part 64, for movement between a first position in which it is shown in FIG. 1 and a second position in which it is shown in FIG. 2. In the first position, the switching member 66 is substantially clear of the exit from the turbine chamber 54, so suction airflow can flow from the suction opening 38 by way of the duct 52 and turbine chamber 54, to the outlet connection for suction airflow to a wand. In the position of FIG. 2, the switching member provides, by way of its internal passage 68, for communication between the duct 62 and the outlet connection to a wand. The path of the suction airflow is shown by arrows on FIGS. 1 and 2.

When the cleaning head is being used on a carpeted floor for example, the user will generally set the switching member (which may be moved by a suitably-positioned control element, preferably shaped for convenient operation by a user's foot, on the exterior of the housing 10) in the position of FIG. 1, so that dust and dirt are sucked through the first suction opening 38 with the brush bar rotating to assist in loosening dust and dirt from the carpet by agitating it. When a hard floor surface is to be cleaned, setting the switching member in the position shown in FIG. 2 will direct suction airflow through the second suction opening 60 which, as it is of a smaller fore and aft dimension than the suction opening 38, will lead to a higher speed of suction airflow therethrough and hence an increased ability to pick up dust and dirt from a hard surface.

Referring now to FIGS. 3 to 6 of the drawings, these illustrate how the invention may be applied to a vacuum cleaner of the upright type. A typical such cleaner, shown in FIG. 3, comprises a cleaning head part indicated generally at 70, able to be supported on a floor surface and moved over such surface on wheels such as indicated at 72 in the vicinity of the rearmost end of the cleaning head part, and on rollers (not shown) at the front end of the head part. At its front end, the cleaning head has a housing 74 which part affords suction openings as shown in more detail in FIGS. 4 to 6.

A body part 76 of the cleaner is pivotably connected to the cleaning head part 70 about a transverse axis towards the rear end of the head part, and comprises a lower portion containing an electric motor and impeller for creating a suction air flow.

Above this portion there is a dirt separating and collecting assembly indicated at 78, which may be of any appropriate type incorporating one or more cyclonic separating stages and/or filters and a suitable receptacle or receptacles for containing separated dust and dirt. The entire assembly 78, or possibly just the dust receptacle(s) thereof, would be removable from the body of the cleaner for emptying of separated dust. The body part of the cleaner further comprises an upwardly-extending handle 80 having a hand grip portion 82 by which a user may manoeuvre the entire cleaner as required over a floor surface. The illustrated cleaner also has a hose 84 and wand 86, enabling cleaning of things other than the floor surface on which the cleaner stands and usable with any appropriate type of cleaning attachment or tool.

Figure 3:
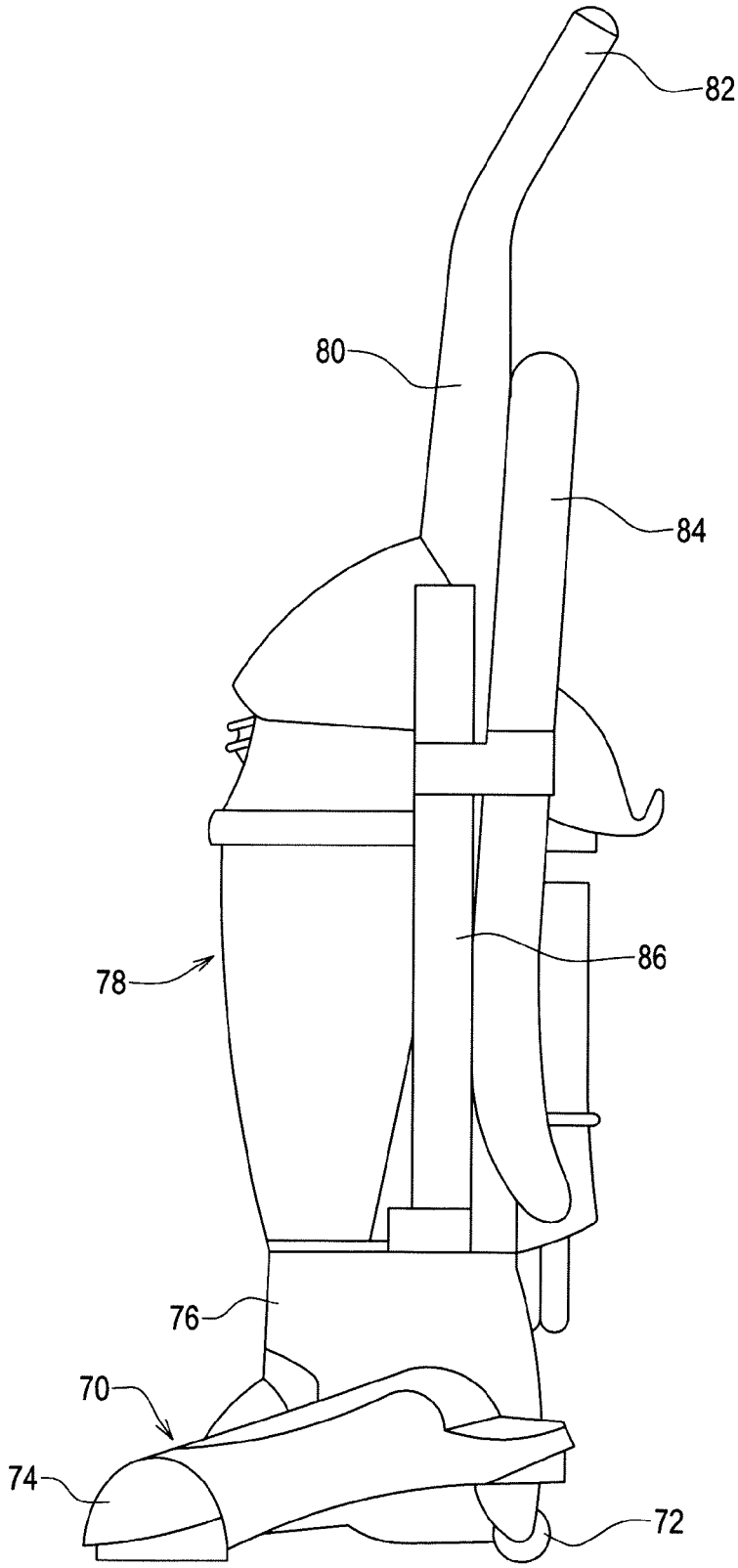
FIG. 3 is a diagrammatic side elevation view of a typical upright vacuum cleaner configured to include the cleaning head of FIG. 1.
Figure 4:
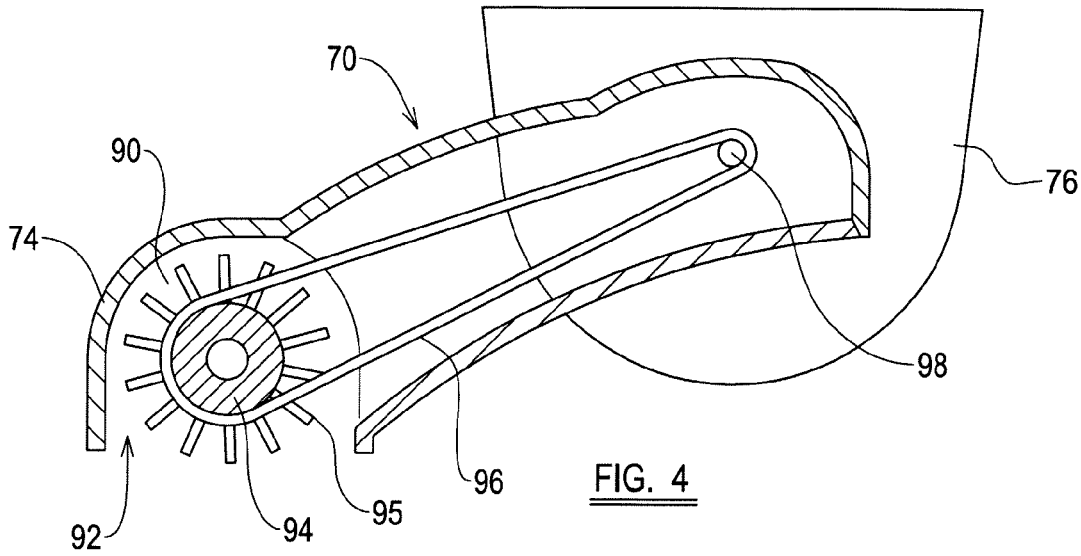
FIG. 4 illustrates a driving structure of an agitator element of the cleaner of FIG. 3.
Figure 5:
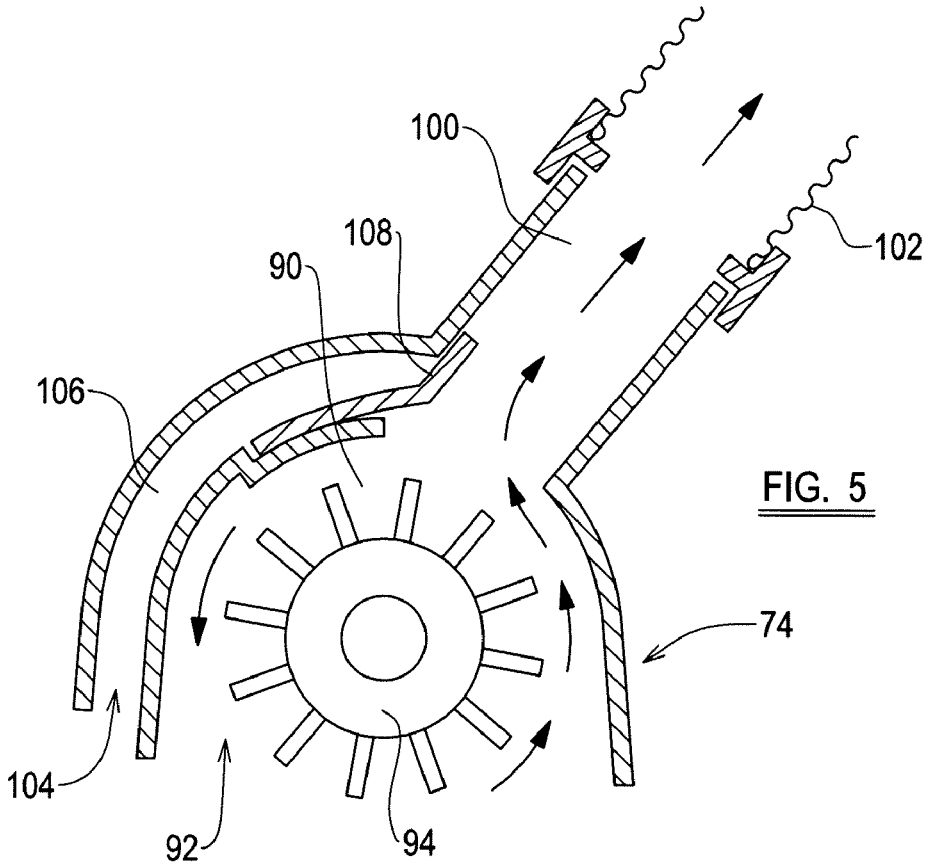
FIG. 5 is a diagrammatic section of a cleaning head part of the cleaner of FIG. 3 in the first mode of operation.
Figure 6:
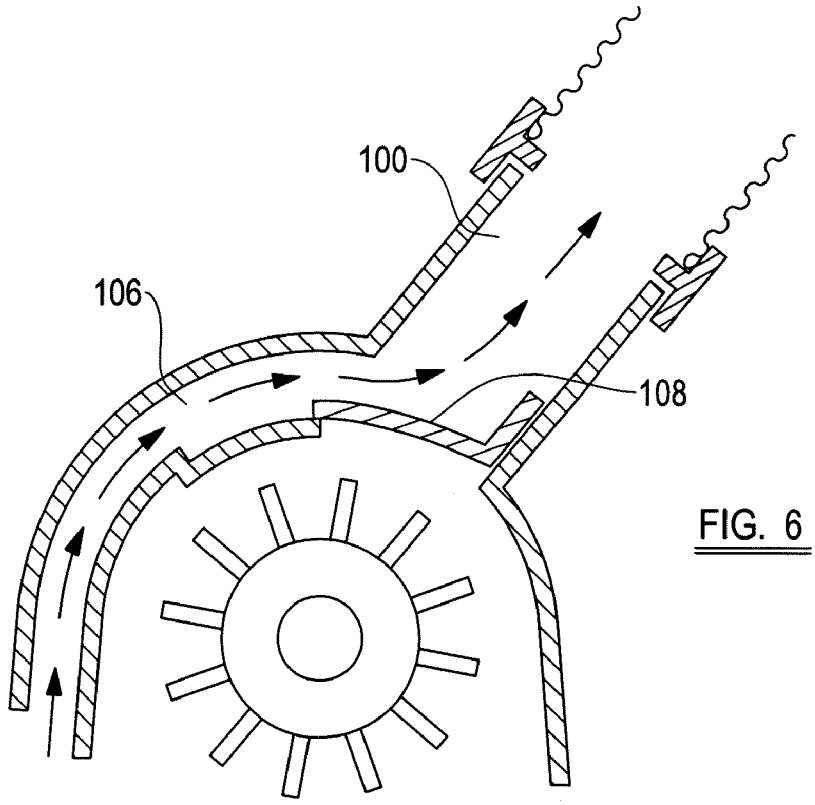
FIG. 6 is a section of FIG. 5 in the second mode of operation.

FIG. 4 illustrates, diagrammatically, a section through a typical known cleaning head part 70 of a cleaner as FIG. 3. The housing 74 at the front of the head part affords a chamber 90 with a suction opening 92 facing the floor surface on which the cleaner stands. Within the chamber 90 there is disposed a transversely extending rotatable agitating element in the form of brush bar 94 having bristles 95. A passage, possibly utilising a short flexible hose portion as shown in FIGS. 5 and 6, leads to the separator and collector 78 of the cleaner. For driving the brush bar 94, a drive belt 96 extends around a pulley part of the brush bar and a further pulley 98 provided on the shaft of a motor incorporated within the lowermost body part 76, which motor also creates the suction air flow for the cleaner.

Referring now to FIGS. 5 and 6 of the drawings, these illustrate how the front housing part 74 of the cleaning head 70 of the cleaner may be arranged in accordance with the invention. The front housing part 74 defines chamber 90, within which rotatable brush bar 94 is disposed, having a suction opening 92. They show passage 100 extending from the chamber 90 connected to a flexible hose portion 102 as above referred to, leading to the dirt separation and collection apparatus 78 of the cleaner.

In accordance with the invention, the housing 74 affords a further suction opening 104, disposed forwardly of the suction opening 92 and of much smaller fore and aft dimension. The front edge of the opening 104 is raised slightly above the level of the rear edge of the opening, and above the suction opening 92. This may be advantageous in respect of allowing larger objects to be picked up from the floor surface, compared with such pick-up if the edges were level with one another. A duct 106 extends from the opening 104, ending where the passage 100 extends from the chamber 90. A switching member 108 is provided, movable between respective positions shown in FIG. 5 and FIG. 6 in which the suction opening 92 and the chamber 90 communicate with the passage 100, and in which the suction opening 104 and duct 106 communicate with the passage 100. In each use, communication between the passage 100 and the respective other suction opening is blocked. The switching member 108 may be moved between such positions by a conveniently positioned operating member on the exterior of the cleaning head part 70 of the cleaner: preferably such an operating member is conveniently shaped for operation by one of the feet of a user of the cleaner.

In analogous manner to that described in relation to FIGS. 1 and 2, when the cleaner is being used on a carpeted floor the user will usually set the switching member 108 in the FIG. 5 position. When the cleaner is being used on a hard floor surface, the user will usually set the switching member 108 in the FIG. 6 position, so that the suction air flow enters the suction opening 104 at high speed, providing greater effectiveness in picking up dust and dirt from the hard surface.

Preferably, when the switching member is set in the FIG. 6 position, the drive to the brush bar 94 is disconnected. In the case where the brush bar is driven from the shaft of the main suction-creating motor of the cleaner, a clutch may be disengaged for such purpose. Upright type cleaners are also known where a brush bar is driven by a separate electric motor and in this case the switching member 108 may operate an electrical switch when it is in its FIG. 6 position, so that the electrical power supply to the brush bar-driving motor is disconnected.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A cleaning head for a vacuum cleaner, comprising a housing with a first suction opening for facing a surface being cleaned;

an agitating element operable on the surface being cleaned through the first suction opening in response to a flow of air;

a second suction opening facing the surface being cleaned; and means operable to switch suction airflow between the first and second suction openings as required, wherein the flow of air is provided only when air passes through the first suction opening.

2. The cleaning head according to claim 1, wherein the agitating element comprises at least one of a rotatable brush or a beater bar, drivable so as to operate on the surface being cleaned.

3. The cleaning head according to claim 1, wherein the suction openings extend transversely of the housing of the cleaning head.

4. The cleaning head according to claim 1, wherein the second suction opening is disposed at a position in front of the first suction opening having regard to the normal direction in which the cleaning head is used.

5. A cleaning head for a vacuum cleaner, comprising:

a housing with a first suction opening for facing a surface being cleaned;

an agitating element operable on the surface being cleaned through the first suction opening;

a second suction opening facing the surface being cleaned; and means operable to switch suction airflow between the first and second suction openings as required, wherein the agitating element is drivable by a turbine powered by suction airflow, the turbine being disposed in a duct leading from the first suction opening to an airflow outlet part of the housing.

6. The cleaning head according to claim 1, wherein the agitating element is drivable by an electric motor.

7. The cleaning head according to claim 6, wherein the electric motor drives only the agitating element.

8. The cleaning head according to claim 6, wherein the electric motor further provides the suction airflow.

9. The cleaning head according to claim 1, wherein the means to switch the suction airflow between the first and second suction openings is operable to stop the agitating means from being driven when the suction airflow flows through the second suction opening.

10. The cleaning head according to claim 5, wherein the second suction opening communicates with a second duct which joins the first duct downstream of the turbine.

11. The cleaning head according to claim 10, wherein the switching means comprises a switching member which opens the first or second duct, and blocks the other of the first or second duct.

12. The cleaning head according to claim 7, wherein the means to switch the suction airflow between the first and second suction openings is configured to operate an electrical switch to switch off the agitating element motor when the suction airflow is switched to the second suction opening.

13. The cleaning head according to claim 8, wherein the means to switch the suction airflow between the first and second suction openings causes disengagement of a clutch device provided in a drive train configured to drive the agitating element, when the suction airflow is directed to the second suction opening.

14. The cleaning head according to claim 1, wherein the second suction opening presents a cross-sectional area which is less than that of the first suction opening.

15. A cleaning head for a vacuum cleaner, comprising:

a housing with a first suction opening for facing a surface being cleaned;

an agitating element operable on the surface being cleaned through the first suction opening in response to a suction air flow through the first suction opening;

a second suction opening facing the surface being cleaned; and a switching member disposed within the cleaning head and movable between a first position to expose the first suction opening to the suction air flow and a second position to expose the second suction opening to the suction air flow.

16. The cleaning head of claim 15, wherein the switching member substantially blocks the second suction opening when disposed in the first position and the switching member substantially blocks the first suction opening when in the second position.

17. The cleaning head of claim 15, further comprising an electric motor configured to drive the agitating member.

18. A cleaning head for a vacuum cleaner, comprising:

a housing with a first suction opening for facing a surface being cleaned;

an agitating element operable on the surface being cleaned through the first suction opening;

a second suction opening facing the surface being cleaned; and a switching member disposed within the cleaning head and movable between a first position to expose the first suction opening to a suction air flow and a second position to expose the second suction opening to the suction air flow, wherein the agitating element is selectively drivable by a turbine disposed to receive suction air flow, the turbine disposed in a duct disposed to provide flow between the first suction opening and an outlet of the housing.

* * * * *